US005725686A

United States Patent [19]

Yoshizawa et al.

[11] Patent Number: 5,725,686

[45] Date of Patent: Mar. 10, 1998

[54] MAGNETIC CORE FOR PULSE TRANSFORMER AND PULSE TRANSFORMER MADE THEREOF

[75] Inventors: Yoshihito Yoshizawa, Fukaya; Yoshio Bizen, Yasugi; Shin Nakajima; Shunsuke Arakawa, both of Kumagaya, all of Japan

[73] Assignee: Hitachi Metals, Ltd., Tokyo, Japan

[21] Appl. No.: 277,583

[22] Filed: Jul. 20, 1994

[30] Foreign Application Priority Data

Jul. 30, 1993 [JP] Japan ..... 5-189647
Aug. 10, 1993 [JP] Japan ..... 5-198057

[51] Int. Cl.[6] ..... H01F 1/147

[52] U.S. Cl. ..... 148/307; 148/305; 420/117; 420/121

[58] Field of Search ..... 148/305, 306, 148/307; 420/117, 121, 82, 89, 93, 122, 123, 124, 125, 126, 127

[56] References Cited

U.S. PATENT DOCUMENTS

| | | | |
|---|---|---|---|
| 4,985,088 | 1/1991 | Okamura et al. | 148/305 |
| 5,067,991 | 11/1991 | Sawa et al. | 148/305 |
| 5,178,689 | 1/1993 | Okamura et al. | 148/306 |
| 5,192,375 | 3/1993 | Sawa et al. | 148/306 |

FOREIGN PATENT DOCUMENTS

| | | | |
|---|---|---|---|
| 0342921 | 11/1989 | European Pat. Off. | 148/307 |
| 0351051 | 1/1990 | European Pat. Off. | 148/307 |
| 0374847 | 6/1990 | European Pat. Off. . | |
| 0392202 | 10/1990 | European Pat. Off. . | |
| 3835986 | 5/1989 | Germany . | |
| 63-239906 | 10/1988 | Japan . | |
| 2235307 | 9/1990 | Japan . | |
| 2295101 | 12/1990 | Japan . | |
| 44393 | 1/1992 | Japan . | |

OTHER PUBLICATIONS

Patent Abstracts of Japan, vol. 11, No. 159 (C–423), 22 May 1987.

*Intermag 93*, 13 Apr. 1993, Stockholm SW, p. AD07, W.K. Pi et al, "Magnetic Properties of $Fe_{73.5}Cu_1Nb_3(Si_{0.6}B_{1-x})_{22.5}$(x=0.4–0.8) Alloy Ribbons Quenched at Different Melting Temperatures".

*IEEE Transactions on Magnetics*, vol. 29, No. 6, Nov. 1993, New York, US, pp. 2670 to 2672, O. Heczko et al, "Magnetic Properties of Compacted Alloy $Fe_{73.5}Cu_1Nb_3Si_{13.5}B_9$ in Amorphous . . . State".

*Primary Examiner*—John Sheehan
*Attorney, Agent, or Firm*—Sughrue, Mion, Zinn, Macpeak & Seas, PLLC

[57] ABSTRACT

A pulse transformer comprising a magnetic core formed of a thin strip of nanocrystalline soft magnetic alloy in which fine nanocrystalline grains having a grain size of not more than 50 nm occupy at least 50 volume % of the structure, characterized in that the AC relative initial magnetic permeability at –20° C. and 50° C. is not less than 50000.

13 Claims, 1 Drawing Sheet

MAGNETIC CORE FOR PULSE TRANSFORMER AND PULSE TRANSFORMER MADE THEREOF

TECHNICAL BACKGROUND OF THE INVENTION

The present invention relates to a magnetic core for a pulse transformer which is made of nanocrystalline soft magnetic alloys, and a pulse transformer for use in a digital signal transmission system or the like.

In the field of electronic circuits, pulse electric technology such as digitization of electronic computers, pulse communication and measuring devices has been developed, and accordingly, there has been an increasing demand for circuit elements which exhibit a high performance in the waveform transmission. A pulse transformer for use in a system which transmits digital signals in the form of pulses, e.g., an ISDN, is a wide-band transformer which is mainly intended for the waveform transmission.

A pulse transformer for "S"-Interface of an ISDN must be designed and manufactured in such a manner as to satisfy electric properties disclosed in, for example, "Interface of INS Net Service", Vol. 2 (Layer 1, Layer 2), the third edition (hereinafter referred to as Document 1) edited by the ISDN Developing Department of NIPPON TELEGRAM and TELEPHONE CORPORATION and published by THE TELECOMMUNICATIONS ASSOCIATION.

In Document 1, an "INS Net 64" service and an "INS Net 1500" service are described. Especially, in a pulse transformer of the former, the primary winding impedance at 10 kHz must be 1250 Ω or more, i.e., about 20 mH or more in terms of the inductance, according to the specification of the electric properties disclosed in pp. 37–55 of Document 1.

Conventionally, pulse transformers are mainly made of magnetic metallic material and ferrite material. As a metallic material, Permalloy (Ni—Fe alloy) and silicon steel (Fe—Si alloy) are employed. Since the metallic material has an excellent low-frequency property and a high saturated magnetic flux density, it is used for a pulse transformer of a large pulse width and a high application level. However, silicon steel involves a problem that it has a low permeability, and that a sufficient inductance can not be provided. Further, Permalloy has an inferior frequency property although the permeability at a low frequency is high, so that it can not be suitably used for a pulse transformer of a small pulse width. Also, because magnetic properties of Permalloy deteriorate by an impact, and because the price is high, using Permalloy for a pulse transformer for interface of an ISDN or the like involves a problem. On the other hand, the ferrite has a lower saturated magnetic flux density than the metallic material and it involves a problem when the applied voltage level is high, but the ferrite has an excellent magnetic properties in high-frequency ranges and a low price. Therefore, the ferrite is currently used for the above-mentioned pulse transformer of a small pulse width in most cases. However, the saturation magnetic flux density of a high-permeability type of ferrite for such pulse transformers is 0.5 T or less, and its permeability is up to about 10000. In consequence, the operation magnetic flux density of the pulse transformer can not be made large, resulting in a problem that the magnetic core becomes larger, and a problem that the cross-sectional area of the core or the number of turns of windings must be increased to obtain a sufficient inductance. When the number of turns is large, the number of operational procedures is increased, and also, the coupling capacitance is raised, thereby deteriorating the transmission property. Moreover, the ferrite has a problem that its temperature property is inferior. Amorphous cobalt-base alloy of a high permeability has a problem that the material price is high, and a problem that its magnetic properties change greatly as time elapses, thus lowering its reliability.

A magnetic core for an interface transformer which is made of nanocrystalline iron-base alloy is disclosed in JP-A-2-295101. It is characterized by consisting of the nanocrystalline iron-base alloy which has a remanence ratio Br/Bs of less than 0.2 and a relative initial permeability of 20000 to 50000, so that an interface transformer having a small volume less number of turns of windings can be realized.

A demand for reducing the size of a pulse transformer must be satisfied. In general, the mounting area must be 12.7 mm×12.7 mm or less, and about three kinds of heights must be provided in accordance with purposes, for example, about 8.9 mm or less for telephones systems, 3.6 mm or less for switchboards of telephone communication system and 2.8 mm or less for IC cards.

Besides, such a pulse transformer must satisfy safety standards determined in each region where it is used. Dielectric strength between the primary and secondary windings and between the windings and the magnetic core must be 500 V in Japan, 1.5 kV in the U.S.A., and 4.0 kV in Europe.

In a pulse transformer for the above-mentioned "INS Net 64", as disclosed in, for example, JP-A-2-235307, there is mainly used an EI-type magnetic core or an EE-type magnetic core which is made of ferrite having a nominal value of an alternating-current (AC) relative initial permeability $\mu_{ri}$ of 10000 or more and which has a connection surface ground with a specular finish, or a continuous D-shaped or B-shaped magnetic core.

In order to reduce the size of a pulse transformer further, a pulse transformer with the following magnetic core is suggested in JP-A-2-295101. The magnetic core is made of an Fe—base alloy containing not less than 60 atom % Fe, in which 50 % or more of the structure consists of microcrystal grains having a grain size of less than 100 nm and magnetostriction is small, and a remanence ratio Br/Bs of this alloy is less than 0.2, and the AC relative initial permeability $\mu_{ri}$ at 10 kHz is in a range of 20000 to 50000. The foregoing JP-A-2-295101 also discloses one embodiment in which a pulse transformer for the "INS Net 64" can be realized by providing windings of about 40 turns around the core having an outer diameter of 14 mm, an inner diameter of 7 mm and a height of 6 mm.

PROBLEMS TO BE SOLVED BY THE INVENTION

As the foregoing magnetic core made of ferrite having a nominal value of an AC relative initial magnetic permeability $\mu_{ri}$ of 10000 or more, there have been known 12001H produced by Tokin Corp. and H25Z produced by Fuji Electrochemical Co., Ltd. which have a nominal $\mu_{ri}$ value of 12000, and H5C2 produced by TDK CORP. and GP-11 produced by Hitachi Ferrite, Ltd. which have a nominal $\mu_{ri}$ value of 10000.

However, a guaranteed $\mu_{ri}$ value of any of these ferrite cores is ±30% of the nominal value. Consequently, even if a continuous toroidal-type, D-shaped or B-shaped magnetic core is used to suppress deterioration of the material properties to the minimum, the pulse transformer must be designed to have a $\mu_{ri}$ of 7000 to 8400 at a frequency of 10 kHz.

In order to obtain a large inductance, either the effective cross-sectional area Ae of a magnetic core or the number of turns N must be increased. However, when the effective cross-sectional area Ae is increased, the magnetic core is enlarged, and when the number of turns N is increased, the strage capacity Cs is increased owing to the windings having a larger number of turns, thereby deteriorating the transmission property.

Therefore, even if a pulse transformer for the "INS Net 64" which satisfies various safety standards is constructed by using the foregoing magnetic core made of ferrite having an AC relative initial permeability $\mu_{ri}$ of 7000 to 8400, with the mounting area being 12.7 mm×12.7 mm, there arise practical problems in the transmission property and so forth. It is difficult to realize the height 2.8 mm or less which is required for IC cards in Japan, the height 3.6 mm or less which is required for switchboards in the U.S.A., and the height 8.9 mm or less which is required for telephones in Europe.

On the other hand, the Fe-base alloy disclosed in JP-A-2-295101 containing not less than 60 atom % Fe, in which 50% or more of the structure consists of nanocrystalline grains having a grain size of less than 100 nm and magnetostriction is small, is manufactured by a single roll quenching method or the like, and industrially produced in the form of thin strips having a thickness of about 10 μm to 30 μm in consideration of the productivity, the production yield and so forth, as described in detail in JP-A-63-239906.

When a magnetic core is constructed by using such a thin Fe-base alloy strip, it is generally formed as a wound core. In this case, a space factor K=Ae/A which is a ratio of an apparent cross-sectional area A of the magnetic core to an effective cross-sectional area Ae of the same varies in accordance with thickness, surface roughness of the thin Fe-base alloy strip, and tensile force applied when the thin alloy strip is formed as a magnetic core. Practically, however, the magnetic core is designed in such a manner that the space factor is about 0.8 or more.

Consequently, if the magnetic core made of the Fe-base alloy disclosed in JP-A-2-295101 is a wound core, an effective AC relative initial permeability $\mu_{rei}=K.\mu_{ri}$, which is a product of the space factor K of the magnetic core and the AC relative initial permeability $\mu_{ri}$ at a frequency of 10 kHz, is $16000 \leqq \mu_{rei} \leqq 40000$ when K is 0.8.

On the other hand, when a pulse transformer for the "INS Net 64" is constructed by using a wound core, the number of turns of the primary winding must be about 50 or less to decrease the strage capacity, so as not to deteriorate the transmission property, and also to decrease the number of operational procedures for the winding.

A wound core disclosed in JP-A-2-295101 in which the AC relative initial permeability $\mu_{ri}$ at a frequency of 10 kHz is 20000 and the space factor K is 0.8, i.e., the effective AC relative initial permeability μrei is 16000, is used to construct a pulse transformer for the "INS Net 64" in which the number of turns of the primary winding is 50, and the mounting area is 12.7 mm×12.7 mm. If such a pulse transformer is provided to satisfy the safety standards of various countries, it is difficult to realize the height 2.8 mm or less which is required for IC cards in Japan and the U.S.A., and the height 3.6 mm or less which is required for switchboards in Europe.

Further, a wound core disclosed in JP-A-2-295101 in which the AC relative initial magnetic permeability $\mu_{ri}$ at a frequency of 10 kHz is the upper limit 50000 and the space factor K is 0.8, i.e., the effective AC relative initial permeability $\mu_{rei}$ is 40000, is used to construct a pulse transformer for the "INS Net 64" in which the number of turns of the primary winding is 50, and the mounting area is 12.7 mm×12.7 mm. If such a pulse transformer is provided to satisfy the safety standards of various countries, the height 2.8 mm or less which is required for IC cards in Japan and the U.S.A. can be realized, but it is difficult to realize the height required for the same purpose in Europe.

In recent years, there has been an increasing demand for reducing the size of pulse transformers, decreasing their thickness, improving their performance, and enhancing their reliability. The pulse transformers are used in environments in wide variety, and must be operated stably even in environments under severe conditions. With the above-described magnetic cores, it is difficult to meet such demands.

SUMMARY OF THE INVENTION

Thus, an object of the present invention resides in providing a magnetic core for a pulse transformer which is made of a nanocrystalline soft magnetic alloy, and a pulse transformer for use in a digital signal transmission system, the magnetic core being smaller in size, improved in performance and more excellent in reliability, especially in the temperature property, than the conventional magnetic core for a pulse transformer.

Taking the above-described problems into consideration, according to the invention, there are provided the following magnetic core for pulse-transformer and a pulse transformer comprising this magnetic core.

1. A magnetic core for a pulse transformer, which is formed of a thin strip of nanocrystalline soft magnetic alloy in which fine nanocrystal grains having a grain size of not more than 50 nm occupy at least 50 volume % of the structure, wherein the alternative-current (AC) relative initial permeability at −20° C. and 50° C. is not less than 50000.

2. A magnetic core for a pulse transformer according to claim 1, which is formed of a thin strip of nanocrystalline soft magnetic alloy in which fine nanocrystal grains having a grain size of not more than 50 nm occupy at least 50 volume % of the structure, the magnetic core having the following magnetic properties:

a) an AC relative initial permeability $\mu_{ri}$ of not less than 60000 when the measuring magnetic field is 0.05 A/m and the frequency is 10 kHz;

b) a pulse relative permeability $\mu_{rp}$ (0.005) of not less than 70,000 when the pulse width is 50 μs and the operation magnetic flux density ΔB is 0.005 T;

c) a pulse relative permeability $\mu_{rp}$ (0.05) of not less than 70,000 when the pulse width is 50 μs and the operation magnetic flux density ΔB is 0.05 T; and d) an effective AC relative initial permeability μrei of not less than 45000, which is a product $K \times \mu_{ri}$ of the AC relative initial permeability $\mu_{ri}$ and a space factor K (=Ae/A where A expresses an apparent cross-sectional area of the magnetic core and Ae expresses its effective cross-sectional area).

3. A pulse transformer comprising a magnetic core which is formed of a thin strip of nanocrystalline soft magnetic alloy in which fine nanocrystal grains having a grain size of not more than 50 nm occupy at least 50 volume % of the structure, the magnetic core having the following magnetic properties:

a) a AC relative initial permeability of not less than 50000 at −20° C. and 50° C.;

b) an AC relative initial permeability μri of not less than 60000 when the measuring magnetic field intensity is 0.05 A/m and the frequency is 10 kHz;

c) a pulse relative permeability $\mu_{rp}$ (0.005) of not less than 70,000 when the pulse width is 50 μs and the operation magnetic flux density ΔB is 0.005 T;

d) a pulse relative permeability $\mu_{rp}$ (0.05) of not less than 70,000 when the pulse width is 50 μs and the operation magnetic flux density ΔB is 0.05 T; and e) an effective AC relative initial permeability $\mu_{rei}$ of not less than 45000, which is a product $K \times \mu_{ri}$ of the AC relative initial magnetic permeability $\mu_{ri}$ and a space factor K (=Ae/A where A expresses an apparent cross-sectional area of the magnetic core and Ae expresses its effective cross-sectional area).

DETAILED DESCRIPTION OF THE INVENTION

Figure 1:
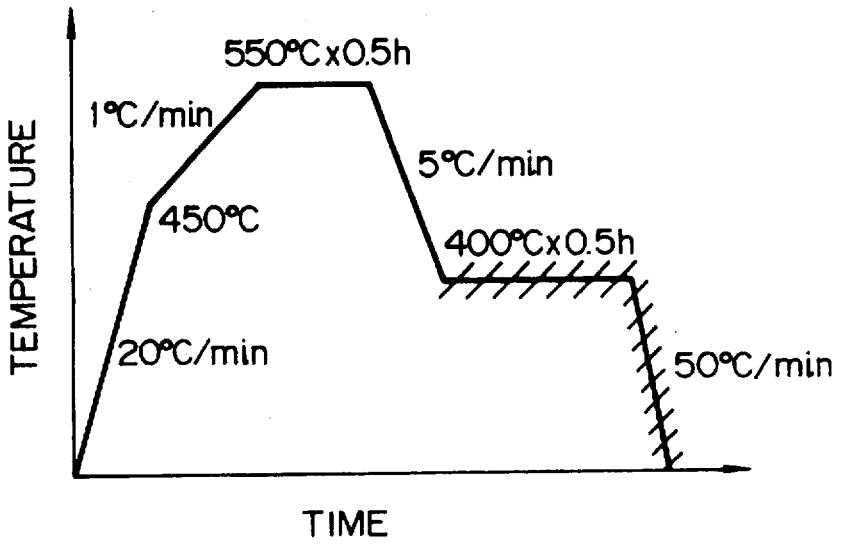
FIG. 1 is a graph illustrative of a heat treatment pattern in Example 1 of the present invention, in which the hatched zone means that the magnetic field is applied to the cores during the heat-treatment.

As a result of investigations by the inventors of the present application, it was found that a magnetic core made of a nanocrystalline soft magnetic alloy having a AC relative initial permeability of 50000 or more at −20° C. and 50° C. was the most suitable as a magnetic core for a pulse transformer for use in a digital signal transmission system.

As a nanocrystalline alloy, there can be suggested an alloy disclosed in JP-B2-4-4393 which mainly consists of iron and includes 0.1 to 3 at % Cu, 0.1 to 30 at % at least one element selected from the group consisting of Nb, W, Ta, Zr, Hf, Ti and Mo, not more than 30 at % Si, and not more than 25 at % B, and an alloy in which the total amount of Si and B is in a range of 5 to 25 at %. Crystal grain sizes of these alloys are 100 nm or less.

Especially when the grain size is not less than 2 nm and not more than 30 nm, a high-performance pulse transformer which enables more reliable wave-form transmission can be obtained.

Further, especially with an alloy which mainly consists of Fe and includes not less than 0.1 and not more than 3 at % at least one element selected from the group consisting of Cu and Au, not less than 1 and not more than 10 at % at least one element selected from the group consisting of Ti, Zr, Hf, V, Nb, Ta, Mo and W, not less than 12 and less than 16.5 at % Si, and not less than 5 and less than 9 at % B, a relative initial permeability of 50000 or more at −20° C. and 50° C. can be easily obtained, and a high-performance pulse transformer which has a favorable level property of the permeability and which enables more reliable wave-form transmission can be obtained.

Crystals in the foregoing alloy are mainly of the body-centered cubic (BCC) phase. The BCC phase may partially include the super lattice. Also, the alloy may partially contain the amorphous phase.

If necessary, the alloy may contain at least one element selected from the group consisting of Cr, Mn, Al, Sn, Zn, Ag, Sc, Y, elements of the platinum group, Re, rare earth elements, C, Ge, P, Ga, Sb, In, Be, As, Mg, Ba and Sr. In some cases, the alloy may contain oxygen, nitrogen, hydrogen, S and so forth as incidental impurities.

When the remanence ratio of the magnetic core is 30% or less, the operation magnetic flux density can be increased, and a high pulse permeability can be maintained until a high operation magnetic flux density. Therefore, the magnetic core can be further decreased in size, and a more favorable result can be obtained.

By using the magnetic core according to the present invention, there can be realized a pulse transformer which has an inductance of more than 20 mH at a frequency of 10 kHz and is excellent in the temperature property, with the magnetic core which has a smaller size than that of the conventional pulse transformer. Such a pulse transformer exhibits a suitable performance for an ISDN.

On the other hand, a magnetic core of which AC relative initial permeability $\mu_{ri}$ at a frequency of 10 kHz is 60000 or more when the measuring magnetic field is 0.05 A/m, and the effective AC relative initial permeability $\mu_{rei}$, which is a product of the AC relative initial magnetic permeability $\mu_{ri}$ and a space factor K, is 45000 or more, is used to construct a pulse transformer for the "INS Net 64" in which the number of turns of the primary winding is 50, height is 2.8 mm or less and the mounting area is 12.7 mm×12.7 mm. Such a pulse transformer can meet the strictest Europe safety standards of the impedance frequency property.

A pulse transformer using a magnetic core of which AC relative initial permeability $\mu_{ri}$ at a frequency of 10 kHz is 100000 or less when the measuring magnetic field is 0.05 A/m, and both the pulse relative permeability $\mu_{rp}$ (0.005) when the pulse width is 50 μs and the operation magnetic flux density ΔB is 0.005 T, and the pulse relative magnetic permeability $\mu_{rp}$ (0.05) when the pulse width is 50 μs and the density ΔB is 0.05 T, are 70000 or more, can prevent the problem of deterioration in the level property of inductance. The pulse transformer for the "INS Net 64" of which the number of turns of the primary winding is 50, the mounting area is 12.7 mm×12.7 mm, and the height is 2.8 mm or less, and which can meet the Europe safety 5. standards, can satisfy the transmission property disclosed in the above-mentioned Document 1.

Magnetic cores according to the present invention are manufactured by the following methods.

One method comprises the steps of manufacturing a thin strip of amorphous alloy by the liquid quenching method and thereafter winding or laminating the strip into a toroidal shape, and performing a heat treatment for microcrystallization and a heat treatment such that the relative initial permeability at −20° C. and 50° C. is 50000 or more. Another method comprises the steps of manufacturing a thin strip of amorphous alloy by the liquid quenching method and thereafter winding or laminating the strip into a toroidal shape, performing a heat treatment for microcrystallization, and further heat treatment applying a magnetic field in a direction perpendicular to the magnetic path length of the magnetic core to perform such that the relative initial permeability at −20° C. and 50° C. is 50000 or more. Especially by performing the heat treatment in the magnetic field, the remanence ratio is decreased so that there can be realized a high-performance pulse transformer which has a magnetic core further reduced in size and which enables more reliable wave-form transmission. When a magnetic field is applied in a direction perpendicular to the magnetic path of a magnetic core, it is applied in a direction of height of the magnetic core or in a radial direction of the core.

The liquid quenching methods are publicly known single or double roll method or the like. The manufacture is usually conducted in the atmosphere, but when the alloy includes active metal, the manufacture is conducted in a certain gas environment. When the strip thickness is less than 10 μm, the manufacture is preferably performed in a depressurized condition so that a thin strip having an excellent surface condition can be produced. The manufactured thin strip of amorphous alloy is about 1 μm to 100 μm in thickness, and usually, it is about 2 μm to 30 μm in thickness. Although the width of the thin strip is about 0.5 mm to 500 mm, a thin strip having a width of 25 mm or less is employed for this purpose in many cases. When a thin strip is laminated, punching or photo-etching of the thin strip is conducted, and the thin strip is formed in a shape to have a closed magnetic circuit in advance.

At least one surface of the thin alloy strip is coated with an insulating material of $SiO_2$, $Al_2O_3$, MgO or the like, thus enabling layer insulation. By performing layer insulation, a pulse transformer having more favorable frequency property can be obtained.

Preferably, an environment for the heat treatments is of inactive gas of Ar, nitrogen or the like. A favorable result can be obtained when the oxygen concentration is 5% or less. More preferably, it is 0.1% or less. The heat treatment for crystallization is normally conducted by heating to a temperature equal to or higher than the crystallization temperature. This heat treatment usually includes a period of time when a certain temperature is maintained. In some cases, however, such a period is unnecessary. When a magnetic field is applied during the heat treatment, application at a temperature lower than that of the crystallization heat treatment is preferred in order to obtain a relative initial permeability of 50000 or more. The crystallization heat treatment is normally conducted at 500° C. to 580° C. within two hours, and the heat treatment in the magnetic field is conducted at a temperature of 300° C. or more, and this temperature is lower than that of the foregoing crystallization heat treatment and lower than the Curie temperature of the BCC phase formed by crystallization. Such a heat treatment is particularly effective for an alloy which mainly consists of Fe and includes not less than 0.1 and not more than 3 at % of at least one element selected from the group consisting of Cu and Au, not less than 1 and not more than 10 at % of at least one element selected from the group consisting of Ti, Zr, Hf, V, Nb, Ta, Mo and W, not less than 12 and less than 16.5 at % Si, and not less than 4 and less than 9 at % B.

The magnetic core is placed in a core casing or its surface is coated, to thereby improve the insulation and the environmental resistance. When it is put in the core casing, grease or a damping material is provided as situations demand. Preferably, the space factor of the magnetic core before placed in the core casing or before coated is as high as possible and 75% or more. More preferably, it is 80% or more.

A material of the magnetic core can be prepared by slitting a thin strip of a large width. In this case, the space factor is increased, and the inductance is improved. Therefore, a higher-performance pulse transformer can be realized.

EXAMPLE 1

A thin strip of amorphous alloy having a composition of $Fe_{bal.}Cu_1Nb_{2.9}Si_{15.3}B_{6.6}$ (at %) which had a width of 2 mm and a thickness of 18 μm was manufactured by the single roll method. Then, this alloy strip was wound to form a toroidal magnetic core having an outer diameter of 14 mm and an inner diameter of 7 mm, and the core was subjected to a heat treatment in accordance with a pattern shown in FIG. 1 (Ar gas environment/Applied Magnetic Field H⊥=240 KA/m).

As a result of X-ray diffraction and structure observation by a transmission electron microscope, it was confirmed that the alloy mainly consisted of crystal grains of the BCC structure having a grain size of about 12 nm. Next, this magnetic core was placed in a casing made of resin, and the relative initial permeability at −20° C. and 50° C. were measured. The relative initial magnetic permeability at −20° C. was 89600, and the relative initial permeability at 50° C. was 88900. The DC B-H loop had a relatively flat, inclined shape. The effective permeability be at 1 kHz was 81000 at −20° C. and 80000 at 50° C. Next, two windings of 12 turns were provided on this magnetic core, thereby producing a pulse transformer. The inductance at 10 kHz was 32 mH at −20° C. and 31 mH at 50° C. when the measuring current was 12 mA. On the other hand, the inductance of a pulse transformer formed of Mn—Zn ferrite was 2 mH at −20° C. and 3 mH at 50° C. when the measuring current was 12 mA, and was remarkably inferior to that of the magnetic core according to the invention.

EXAMPLE 2

Figure 2:
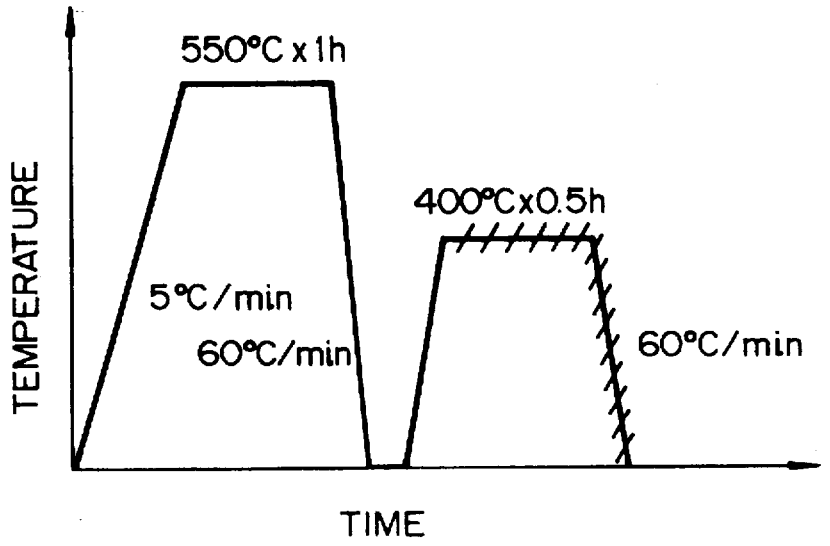
FIG. 2 is a graph illustrative of a heat treatment pattern in Example 2 of the invention, in which the hatched zone means that the magnetic field is applied to the cores during the heat-treatment.

Molten alloys having compositions shown in Table 1 were quenched and formed into thin strips of amorphous alloy having a width of 6.5 mm and a thickness of 14 μm by the single roll method. Then, these alloy strips were wound to form toroidal magnetic cores having an outer diameter of 14 mm and an inner diameter of 7 mm, and the cores were subjected to a heat treatment in accordance with a pattern shown in FIG. 2 (Ar gas environment/Applied Magnetic Field H⊥=220 KA/m). As a result of X-ray diffraction and structure observation by a transmission electron microscope, it was confirmed that the alloys consisted of nanocrystalline grains having a grain size of 2 to 30 nm. Next, these magnetic cores were placed in casings made of resin, and the relative initial permeabilities at −20° C. and 50° C. were measured. Also, the remanence ratios Br.Bs-1 were measured. Then, two windings of 21 turns were provided on each of these magnetic cores, thereby producing a pulse transformer. The relative initial permeability at −20° C. μi (−20), the relative initial permeability at 50° C. μi (50), the remanence ratios $Br.Bs^{-1}$, the inductance at −20° C. L (−20) at 10 kHz, and the inductance at 50° C. L (50) at 10 kHz are shown in Table 1.

The magnetic cores according to the present invention can realize a higher inductance than the conventional magnetic cores having the same number of turns. That is to say, the same level of inductance as the conventional magnetic cores can be provided by the invented magnetic cores having a smaller number of turns and a smaller size. Moreover, the invention magnetic cores are excellent in temperature properties. Thus, a high-performance pulse transformer can be realized.

TABLE 1

| | COMPOSITION (at %) | μi(−20) | μi(50) | Br.Bs-1 (%) | L(−20) (mH) | L(50) (mH) |
|---|---|---|---|---|---|---|
| INVENTION EXAMPLE | $Fe_{bal.}Cu_{1.1}Nb_{2.8}Si_{15.4}B_{6.7}$ | 72500 | 71000 | 12 | 62 | 61 |
| | $Fe_{bal.}Cu_{1.1}Nb_{3.2}Si_{12.0}B_{7.3}$ | 62800 | 62000 | 14 | 54 | 53 |
| | $Fe_{bal.}Cu_{1.1}Zr_{7.3}Ti_{0.5}Si_{12.0}B_{6.3}$ | 50100 | 50200 | 35 | 43 | 43 |
| | $Fe_{bal.}Cu_{1.1}Mo_{3.2}Si_{14.0}B_{8.9}$ | 52200 | 51100 | 20 | 45 | 44 |
| | $Fe_{bal.}Cu_{1.1}Ta_{2.2}Si_{15.0}B_{8.2}$ | 53400 | 53200 | 18 | 46 | 46 |
| | $Fe_{bal.}Cu_{1.1}W_{5.2}Si_{16.3}B_{7.9}$ | 50200 | 50000 | 23 | 43 | 43 |
| | $Fe_{bal.}Cu_{1.1}Hf_{2.2}Si_{15.3}B_{5.5}$ | 51100 | 50900 | 25 | 44 | 44 |
| | $Fe_{bal.}Cu_{1.1}Nb_{2.2}V_1Si_{15.3}B_6$ | 68000 | 67000 | 11 | 58 | 58 |
| COMPARATIVE EXAMPLE | $Fe_{bal.}Cu_1Nb_3Si_{13.5}B_9$ | 35400 | 31000 | 9 | 30 | 26 |
| | $Fe_{bal.}Cu_1Nb_3Si_{16.5}B_6$ | 32000 | 38000 | 12 | 27 | 32 |
| | $Fe_{bal.}Cu_{1.1}Nb_3Si_4B_{12.5}$ | 15000 | 13200 | 23 | 13 | 11 |
| | Mn—Zn FERRITE | 4600 | 8000 | 20 | 2 | 3 |

EXAMPLE 3

Two windings of 15 turns were provided on each of the magnetic cores described in Example 2, thereby producing a pulse transformer. The effective pulse permeabilities μp when the pulse width was 10 μs and the operation magnetic flux density ΔB was 1 T were measured. The obtained results are shown in Table 2. Especially, magnetic cores according to the present invention having remanence ratios of 30% or less provide high effective pulse permeabilities μp and are excellent.

TABLE 2

| | COMPOSITION (at %) | $\mu_p$ |
|---|---|---|
| INVENTION EXAMPLE | $Fe_{bal.}Cu_{1.1}Nb_{2.8}Si_{15.4}B_{6.7}$ | 20000 |
| | $Fe_{bal.}Cu_{1.1}Nb_{3.2}Si_{12.0}B_{7.3}$ | 19500 |
| | $Fe_{bal.}Cu_{1.1}Zr_{7.3}Ti_{0.5}Si_{12.0}B_{6.3}$ | 9000 |
| | $Fe_{bal.}Cu_{1.1}Mo_{3.2}Si_{14.0}B_{8.9}$ | 14200 |
| | $Fe_{bal.}Cu_{1.1}Ta_{2.2}Si_{15.0}B_{8.2}$ | 13100 |
| | $Fe_{bal.}Cu_{1.1}W_{5.2}Si_{16.3}B_{7.9}$ | 12400 |
| | $Fe_{bal.}Cu_{1.1}Hf_{2.2}Si_{15.3}B_{5.5}$ | 12200 |
| | $Fe_{bal.}Cu_{1.1}Nb_{2.2}V_1Si_{15.3}B_6$ | 21000 |

*"bal."means "balance".

EXAMPLE 4

In order to realize pulse transformers having a mounting area 12.7 mm×12.7 mm and a height of 2.8 mm or less which were required for IC cards for the "INS Net 64", thin strips of amorphous alloy having a composition of $Fe_{73.5}Cu_1Nb_3Si_{13.5}B_9$, a width of 1.5 mm and a thickness of about 20 μm were manufactured by the single roll method and used to manufacture wound cores of a toroidal shape having an outer diameter of 11 mm, an inner diameter of 6 mm and a height of 1.5 mm. The would cores were subjected to a heat treatment in a nitrogen atmosphere at 550° C. which was not less than the crystallization temperature of the amorphous alloy, and were cooled slowly. The wound cores made of the nanocrystalline soft magnetic alloy thus manufactured were placed in casings made of polypropylene which have an outer diameter of 11.6 mm, an inner diameter of 5.4 mm and a height of 2.2 mm. Table 3 shows effective saturation magnetic flux densities Bs and remanence ratios Br/Bs measured at a magnetic field of 800 A/m, AC relative initial permeabilities $\mu_{ri}$ at a magnetic field of 0.05 A/m and a frequency of 10 kHz, pulse relative permeabilities $\mu_{rp}$ (0.005) when the pulse width was 50 μs and the operation magnetic flux density ΔB was 0.005 T, and pulse relative permeabilities $\mu_{rp}$ (0.05) when the pulse width was 50 μs and the density μB was 0.05 T of the magnetic cores 1 to 7.

It should be noted that any of the magnetic cores 1 to 7 and magnetic cores A and B was manufactured to have a space factor K of 0.85.

In this case, magnetic properties of the cores 1 to 7 varied by changing time of the heat treatment at 550° C. and a temperature gradient of annealing from 550° C. to a room temperature.

The magnetic cores A and B were magnetic cores having the properties disclosed in JP-A-2-295101, and were manufactured by substantially the same method as the magnetic cores 1 to 7 except for heat treatments.

As the heat treatments, the methods disclosed in JP-A-1-247557 were employed. The magnetic core A was manufactured by performing a heat treatment in a nitrogen atmosphere at 550° C. for one hour followed by air-cooling, and performing a heat treatment at 500° C. for one hour while applying a magnetic field of 240 kA/m in the widthwise direction of the thin alloy strip which was perpendicular to the magnetic path of the core, followed by air-cooling. The magnetic core B was manufactured by performing a heat treatment in a nitrogen atmosphere at 550° C. for one hour followed by air-cooling, and performing a heat treatment at 400° C. for one hour while applying a magnetic field of 240 kA/m in the widthwise direction of the thin alloy strip which was perpendicular to the magnetic path of the core, followed by air-cooling.

TABLE 3

| MAGNETIC CORE | Bs(T) | Br/Bs | $\mu_{ri}$ | $\mu_{rei}$ | $\mu_{rp}$ (0.005) | $\mu_{rp}$ (0.05) |
|---|---|---|---|---|---|---|
| MAGNETIC CORE 1 | 1.24 | 0.61 | 60400 | 51300 | 71200 | 71100 |
| MAGNETIC CORE 2 | 1.24 | 0.57 | 74300 | 63200 | 78500 | 78100 |
| MAGNETIC CORE 3 | 1.24 | 0.61 | 81600 | 69400 | 91600 | 91200 |
| MAGNETIC CORE 4 | 1.24 | 0.63 | 99400 | 84500 | 113000 | 111000 |
| MAGNETIC CORE 5 | 1.24 | 0.48 | 84000 | 71400 | 90900 | 70500 |
| MAGNETIC CORE 6 | 1.24 | 0.58 | 92800 | 78900 | 109000 | 76400 |
| MAGNETIC CORE 7 | 1.24 | 0.63 | 98400 | 83600 | 112000 | 70200 |
| MAGNETIC CORE A | 1.24 | 0.08 | 24800 | 21100 | 29300 | 29800 |
| MAGNETIC CORE B | 1.24 | 0.18 | 47300 | 40200 | 52600 | 52200 |

The pulse transformer for evaluation were manufactured with the above-described magnetic cores shown in Table 3, so as to realize pulse transformers for the "INS Net 64"

having the mounting area of 12.7 mm ×12.7 mm and the height of 2.8 mm or less. The evaluation results of these pulse transformers are shown in Table 4.

In Table 4, the number of turns of the primary winding was selected to satisfy electric properties such as the primary winding inductance and the transmission property which were required for a pulse transformer for the "INS Net 64". However, in a pulse transformer of a comparative example A alone, the number of turns for satisfying the primary winding inductance was too large, and consequently, the capacity of the primary winding was too large, so that a satisfactory transmission property could not be obtained.

TABLE 4

| TRANS-FORMER | MAGNETIC CORE | NUMBER OF TURNS OF PRIMARY WINDING | TRANSMISSION PROPERTY | EUROPE SAFETY STANDARDS | OPERATION EFFICIENCY |
|---|---|---|---|---|---|
| INVENTION EXAMPLE 1 | MAGNETIC CORE 1 | 47 | ○ | ○ | ○ |
| INVENTION EXAMPLE 2 | MAGNETIC CORE 2 | 42 | ○ | ○ | ○ |
| INVENTION EXAMPLE 3 | MAGNETIC CORE 3 | 40 | ○ | ○ | ○○ |
| INVENTION EXAMPLE 4 | MAGNETIC CORE 4 | 37 | ○ | ○ | ○○ |
| INVENTION EXAMPLE 5 | MAGNETIC CORE 5 | 43 | ○ | ○ | ○ |
| INVENTION EXAMPLE 6 | MAGNETIC CORE 6 | 42 | ○ | ○ | ○ |
| INVENTION EXAMPLE 7 | MAGNETIC CORE 7 | 44 | ○ | ○ | ○ |
| COMPARA-TIVE EXAMPLE A | MAGNETIC CORE A | 74 | X | X | X |
| COMPARA-TIVE EXAMPLE B | MAGNETIC CORE B | 53 | ○ | X | X |

Further, as understood from Table 4, it was found that the number of turns of the primary winding must be not more than 50, as in pulse transformers in the invention examples 1 to 7 in order to satisfy the dielectric strength 4 kV between the primary and secondary windings and between the windings and the magnetic core which were determined by the safety standards in Europe. It was also found that the effective AC relative initial magnetic permeability μrei of the magnetic core must be about 45000 or more in order to obtain the inductance of 20 mH or more at a frequency 10 kHz which was required for a pulse transformer for the "INS Net 64".

Therefore, the comparative examples A and B including magnetic cores whose permeabilities $\mu_{rei}$ were less than 45000, could not attain the Europe safety standards.

In the pulse transformers in the invention examples 1 to 7, especially in the invention examples 3 and 4, the number of turns of the primary winding was so small that the operational efficiency was significantly excellent.

Moreover, the magnetic cores used in the pulse transformers according to this invention having the above-described properties had an advantage that they could be manufactured by a heat treatment without application of a magnetic field.

In the foregoing description, pulse transformers for IC cards or the like whose mounting area is the smallest of all the pulse transformers for the "INS Net 64" and which must be reduced in thickness, have been taken as examples for explaining the effectiveness of the present invention. Needless to say, however, this invention is also effective for realizing both size reduction and performance improvement of pulse transformers for switchboards for telephone communication system or pulse transformers for other purposes which are used in substantially the same frequency bands as the pulse transformers for the "INS Net 64".

As has been apparent from the above, according to the invention, there can be provided a magnetic core for a pulse transformer which is made of a nanocrystalline soft magnetic alloy, and a pulse transformer for use in a digital signal transmission system, the magnetic core being smaller in size, improved in performance and more excellent in reliability, especially in the temperature dependence of magnetic property, than the conventional magnetic core for a pulse transformer.

According to the invention, there can be realized a small-sized high-performance pulse transformer used for an IC card for the "INS Net 64" which has a mounting area of 12.7 mm×12.7 mm or less and a height of 2.8 mm or less and which even satisfies the strictest Europe safety standards.

What is claimed is:

1. A magnetic core for a pulse transformer, which is formed of a thin strip of nanocrystalline soft magnetic alloy in which fine nanocrystalline grains having a grain size of not more than 50 nm occupy at least 50 volume % of the structure, wherein the relative initial permeability at −20° C. and 50° C. is not less than 50,000, wherein said nanocrystalline soft magnetic alloy consists essentially of, by atomic percent, not less than 0.1% and not more than 3% of at least one element selected from the group consisting of Cu and Au, not less than 1% and not more than 10% of at least one element selected from the group consisting of Ti, Zr, Hf, V, Nb, Ta, Mo and W, not less than 12% and less than 16.5% of Si, not less than 4% and less than 9% of B, and the balance of Fe.

2. A magnetic core for a pulse transformer according to claim 1, which is formed of a thin strip of nanocrystalline soft magnetic alloy in which fine nanocrystal grains having a grain size of not more than 50 nm occupy at least 50 volume % of the structure, said magnetic core having the following magnetic properties:

a) an AC relative initial permeability $\mu_{ri}$ of not less than 60,000 when the measuring magnetic field is 0.05 A/m and the frequency is 10 kHz;

b) a pulse relative permeability $\mu_{rp}$ (0.005) of not less than 70,000 when the pulse width is 50 μs and the operation magnetic flux density ΔB is 0.005 T;

c) a pulse relative permeability $\mu_{rp}$ (0.05) of not less than 70,000 when the pulse width is 50 μs and the operation magnetic flux density ΔB is 0.05 T; and d) an effective AC relative initial permeability $\mu_{rei}$ of not less than 45,000, which is a product $K \times \mu_{ri}$ of the AC relative initial permeability $\mu_{ri}$ and a space factor K (=Ae/A where A expresses an apparent cross-sectional area of the magnetic core and Ae expresses its effective cross-sectional area).

3. A pulse transformer comprising a magnetic core which is formed of a thin strip of nanocrystalline soft magnetic alloy in which fine nanocrystal grains having a grain size of not more than 50 nm occupy at least 50 volume % of the structure, said magnetic core having the following magnetic properties:

a) a AC relative initial permeability of not less than 50,000 at −20° C. and 50° C.;

b) an AC relative initial permeability $\mu_{ri}$ of not less than 60,000 when the measuring magnetic field is 0.05 A/m and the frequency is 10 kHz;

c) a pulse relative permeability $\mu_{rp}$ (0.005) of not less than 70,000 when the pulse width is 50 μs and the operation magnetic flux density ΔB is 0.005 T;

d) a pulse relative magnetic permeability $\mu_{rp}$ (0.05) of not less than 70,000 when the pulse width is 50 μs and the operation magnetic flux density ΔB is 0.05 T; and e) an effective AC relative initial permeability $\mu_{rei}$ of not less than 45,000, which is a product $K \times \mu_{ri}$ of the AC relative initial permeability $\mu_{ri}$ and a space factor K (=Ae/A where A expresses an apparent cross-sectional area of the magnetic core and Ae expresses its effective cross-sectional area), wherein said nanocrystalline soft magnetic alloy consists essentially of, by atomic percent, not less than 0.1% and not more than 3% of at least one element selected from the group consisting of Cu and Au, not less than 1% and not more than 10% of at least one element selected from the group consisting of Ti, Zr, Hf, V, Nb, Ta, Mo and W, not less than 12% and less than 16.5% of Si, not less than 4% and less than 9% of B, and the balance of Fe.

4. A magnetic core for a pulse transformer according to claim 1, wherein a remanence ratio of the material of the magnetic core is not more than 30%.

5. A magnetic core for a pulse transformer according to claim 1, wherein an average crystal grain diameter of the nanocrystalline soft magnetic alloy is 2 to 30 nm.

6. A pulse transformer according to claim 2, which has inductance of more than 20 mH at −20° C. and 50° C. at 10 kHz.

7. The magnetic core for a pulse transformer according to claim 1, wherein the alloy is subjected to a heat treatment by being heated to a temperature equal to or higher than the crystallization temperature.

8. The magnetic core for a pulse transformer according to claim 7, wherein the alloy is subjected to a heat treatment by being heated to a temperature of 500° C. to 580° C.

9. The magnetic core for a pulse transformer according to claim 8, wherein the alloy is subjected to a heat treatment by being heated to a temperature lower than the crystallization temperature and wherein a magnetic field is applied during the heat treatment.

10. The magnetic core for a pulse transformer according to claim 9, wherein the alloy is subjected to the heat treatment in the magnetic field by being heated to a temperature of 300° C. or more, and wherein the heat treatment temperature is lower than the temperature of the crystallization heat treatment and is lower than the Curie temperature of the BCC phase formed by crystallization.

11. A magnetic core for a pulse transformer, according to claim 1, wherein said not less than 1% and not more than 10% of at least one element selected from the group consisting of Ti, Zr, Hf, V, Nb, Ta, Mo and W is not less than 1% and not more than 10% of V and Nb.

12. A magnetic core for a pulse transformer, according to claim 2, wherein said not less than 1% and not more than 10% of at least one element selected from the group consisting of Ti, Zr, Hf, V, Nb, Ta, Mo and W is not less than 1% and not more than 10% of V and Nb.

13. A pulse transformer, according to claim 3, wherein said not less than 1% and not more than 10% of at least one element selected from the group consisting of Ti, Zr, Hf, V, Nb, Ta, Mo and W is not less than 1% and not more than 10% of V and Nb.

* * * * *